United States Patent [19]

Tsukamoto

[11] 3,944,757

[45] Mar. 16, 1976

[54] HIGH-FIDELITY MOVING-COIL LOUDSPEAKER

[76] Inventor: Kenkichi Tsukamoto, 47, Koyamashimofusa-cho, Kita, Kyoto, Japan

[22] Filed: Aug. 1, 1974

[21] Appl. No.: 493,891

[30] Foreign Application Priority Data

Aug. 4, 1973 Japan ..... 48-87720

[52] U.S. Cl. ..... 179/115.5 H; 181/152; 181/184; 181/191; 181/192

[51] Int. Cl.[2] ..... H04R 9/06

[58] Field of Search ..... 179/115.5 R, 115.5 H; 181/152, 159, 175, 176, 177, 182, 184, 185, 191, 192, 193, 194, 195, 196, 179, 188, 199

[56] References Cited

UNITED STATES PATENTS

| | | | |
|---|---|---|---|
| 1,002,205 | 8/1911 | Graham | 181/193 |
| 1,081,352 | 12/1913 | Weber | 181/194 |
| 1,687,566 | 10/1928 | Hunt | 181/177 |
| 1,763,381 | 6/1930 | Van Dyck et al. | 181/193 |
| 1,806,598 | 5/1931 | Denoux | 181/188 |
| 1,809,035 | 6/1931 | Hawley | 181/177 |
| 2,146,325 | 2/1939 | Allison | 181/194 |

FOREIGN PATENTS OR APPLICATIONS

| | | | |
|---|---|---|---|
| 317,339 | 8/1929 | United Kingdom | 179/115.5 R |
| 847,921 | 6/1952 | Germany | 181/31 |
| 1,137,483 | 10/1962 | Germany | 181/31 B |
| 1,086,750 | 8/1960 | Germany | 181/31.1 |
| 364,285 | 10/1962 | Switzerland | 181/31 B |

OTHER PUBLICATIONS

Electronic Engineering, Apr. 1946, pp. 109–111, "Microphones — A Detailed Review of their Design and Characteristics," S. W. Amos et al.

*Primary Examiner*—Kathleen H. Claffy
*Assistant Examiner*—George G. Stellar
*Attorney, Agent, or Firm*—George B. Oujevolk

[57] ABSTRACT

In a moving-coil type loudspeaker, a tubular member of a length longer than the wave-length of any one of the frequencies in a desired frequency range and having a constant cross-sectional area along its length, is coupled, at one end thereof, with one side of a vibrating plate or diaphragm through an acoustic transformer constituted by a cavity formed therebetween, whereby the loudspeaker is capable of reproducing sounds with high fidelity particularly in extremely low frequency ranges.

2 Claims, 16 Drawing Figures

HIGH-FIDELITY MOVING-COIL LOUDSPEAKER

BACKGROUND OF THE INVENTION

This invention relates generally to high fidelity loudspeakers, and more particularly to a type thereof wherein a vibrating plate or diaphragm driven by a moving coil type driver unit is coupled through an acoustic transformer to a tubular member of a substantial length, whereby a suitable acoustic radiation resistance is imparted to the diaphragm to place it in resistance control condition thereby to make possible the high fidelity acoustic reproduction over a wide sound range especially for a low sound range of 20 c/s to several hundreds of c/s.

As a result of recent study, it has been found that the direct radiation type loudspeakers such as those having conical diaphragms can produce sounds under inertia control condition such that the amplitude of the diaphragm increases in inverse proportion to the second power of its frequency and, in some cases, exceeds several millimeters when the frequency of the sound is extremely low. Such a great amplitude of the diaphragm inevitably causes free vibrations of the diaphragm, thus giving rise to the generation of creaking noise due to the extreme deformation of the material of the diaphragm, such noise being particularly detrimental to the tone color of the reproduced sound.

Although this kind of noise can be eliminated by the employment of a horn type loudspeaker having a conventional conical or exponential horn, the diaphragm thereof being placed in resistance control condition for a frequency range exceeding the cut-off frequency, the horn type loudspeaker is adapted to the reproduction of high-frequency sound rather than low-frequency sound. Accordingly, when it is desired to reproduce a sound of a frequency lower than the cut-off frequency of the horn type loudspeaker with high fidelity, the peripheral length of the opening portion of the horn must be greater than the wavelength $\lambda$ of the cut-off frequency ($\lambda = 341$ m/sec. $\div 20$ c/s $\approx 17.0$ m), and the diameter D of the same portion must be greater than $\lambda \div \pi = 5.43$ m. It is almost impossible to manufacture a loudspeaker of such enormous size.

Furthermore, the acoustic impedance of the conical or exponential horn is not a pure resistance over a low frequency range lower than the cut-off frequency. Therefore, it is difficult for the horn type loud-speaker to produce sound of a frequency lower than the cut-off frequency under resistance control condition.

Thus, the various types of the conventional loudspeakers have difficulties in producing sound of a frequency varying in a wide range with high fidelity under resistance control condition, and these difficulties become worse particularly when the sound is in an extremely low frequency range.

SUMMARY OF THE INVENTION

A primary object of the present invention is to provide a novel and unique moving-coil loudspeaker with a vibrating plate wherein sound of a wide frequency range can be effectively produced with high fidelity under resistance control condition of the vibrating plate.

Another object of the present invention is to provide a novel moving-coil type loudspeaker whereby sound in an extremely low frequency range can be produced with high fidelity by applying a suitable radiation resistance to the vibrating plate.

These and other objects of the present invention can be achieved by a novel moving-coil loudspeaker which comprises means for producing a d.c. magnetic field, a moving coil disposed in the d.c. magnetic field to be oscillated in response to a signal current applied thereto, and a vibrating plate fixed to the moving coil for converting the oscillation of the moving coil to sound, and in which there is further provided a tubular member having a length greater than the longest wavelength of sound in a desired operable frequency range and a constant cross-sectional area throughout the length less than the area of the vibrating plate, with a coupling member connecting an end of the tubular member to one side of the vibrating plate so as to form an air chamber therebetween.

The nature, principle, and utility of the present invention will be more clearly understood from the following detailed description of the invention when read in conjunction with the accompanying drawings wherein like parts are designated by like reference numerals.

BRIEF DESCRIPTION OF THE DRAWING

In the drawings:

FIG. 2(*b*) is an equivalent construction diagram corresponding to the example shown in FIG. 2(*a*);

DETAILED DESCRIPTION OF THE INVENTION

Figure 1:
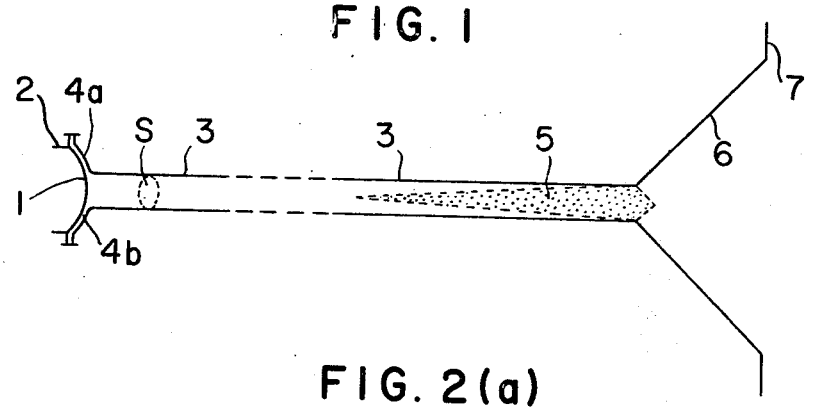
FIG. 1 is a diagrammatic side view, in longitudinal section, showing a basic construction of the loudspeaker according to the present invention.

As conducive to a full understanding of the present invention, the fundamental principles underlying the invention will now be described in detail.

An air column within a tubular member having an infinite length and a constant cross section along the length exhibits an acoustic impedance in the form of a substantially pure resistance. Since it is impossible, however, to manufacture a tubular member of infinite length, there is provided, in the loudspeaker according to the present invention, a tubular member equivalently analogous to a tubular having infinite length, and a diaphragm of the loudspeaker is placed in resistance control condition by acoustically coupling the equivalent tubular member to the diaphragm through an acoustic transformer.

Although the mechanical reactance of the diaphragm is greater than the acoustic characteristic impedance of air, a resultant acoustic resistance far greater than the mechanical reactance can be obtained in a desired frequency range of the output sound when the constant cross-sectional area of the tubular member is reduced to the extent of $1/n$ or one tenth of the ½ (wherein $n$ is an integer less than 10, for instance), thereby reducing the transformation ratio of the acoustic transformer formed by the cavity of the aforementioned forward chamber to a value substantially smaller than one. In other words, when a tubular member similating that of infinite length and having a constant cross-sectional area is coupled to one side of the diaphragm by the use of a coupling member thereby forming a transforming cavity, the reproduction of sound from the vibrating plate can be highly effective under resistance control condition in a desired frequency range due to the high resistance component of the acoustic impedance, and an output sound of high fidelity can be thereby obtained.

The length of the tubular member is selected to be sufficiently longer than the longest wavelength of a sound belonging to the desired frequency range, and means for reducing the creation of a standing wave is further provided therein. The means for reducing the standing wave may comprise an acoustic resistance imparting body made of a sound absorbing substance, an acoustic impedance matching member such as a horn provided at an end of the tubular member, or slit means also provided at the end of the tubular member.

For further assuring the reproduction of sound in a desired frequency range with high fidelity, an acoustic transformer is formed in a cavity defined by the diaphragm, the coupling member, and an end of the tubular member, as described hereinbefore, and in this acoustic transformer, an annular cross-sectional area of the cavity sectioned by a sphere having its center positioned on the longitudinal axis of the tubular member near the end portion thereof and having diameter selected at an arbitrary value, is made substantially equal to the constant cross-sectional area of the tubular member. By the above-described configuration of the transforming cavity, a high-range blocking filter action caused by the volume of the transformer cavity can be prevented, and the sound can be reproduced with high fidelity in a wide frequency range.

In the case where the aforementioned high-range blocking filter action of the cavity is to be utilized positively, the values of the above-mentioned two cross-sections may be differentialed from each other, or a low-pass filter or a high-range blocking filter may be provided at a suitable position between in two ends of the tubular member.

Furthermore, also within the scope of the present invention, a radiation of sound from the rear side of the diaphragm may be used, as hereinafter described in more detail, as well as the radiation from the front side of the diaphragm, and it is found that these radiations are both of high fidelity on account of the fact that the diaphragm is placed in acoustic resistance control condition.

In the characteristic of the moving-coil loudspeaker according to the present invention, there is no cut-off frequency, unlike in the case of the conventional horn speaker, this feature constituting an advantage of the present invention.

It is widely known that the reflection of a sound from a surface can be eliminated by the provision of a conical sound absorbing body of a length, $\lambda/4$ (wherein, $\lambda$ is the wavelength of the sound). Since the wavelength $\lambda$ corresponding to a frequency 20 c/s of a sound is 17 m, $\lambda/4 = 4.25$ m. Thus, a tubular member including a sound-absorbing conical body having a length 4.25 m and a diameter of several centimeters can be bent around with a radius of curvature several times greater them the cross-sectional diameter of the tubular member without affecting the acoustic characteristic thereof, and for this reason, the loudspeaker according to the present invention can be applied to various acoustic equipment for domestic use.

It has been found that an extremely low frequency sound in a range of from 20 to 30 c/s can be radiated from a diaphragm of a diameter ranging from a few cm to 20 or 30 cm into the above described tubular member with a conversion efficiency of several percent to several tens of percent.

Acoustic tubes having lengths of several meters have been used for a long time for the transmission of sound or as an acoustic resistance. However, such tubes have not been used extensively for directly radiating a sound to the outer atmosphere particularly in the cases where the sound is heard at a position separated from the loudspeaker by several meters. The reason for this is that the acoustic tube suffers from various drawbacks which are considered as being almost total. The most serious of the drawbacks is in the difficulty in matching between the acoustic impedance within the acoustic tube and that of the outer atmosphere, and if the impedance matching is not sufficient, standing waves are created in the acoustic tube at frequencies which are ½, 1, 2, 3, - - - times the wavelengths thereof corresponding to the length of the acoustic tube, whereby the reproduction of sound waves at high fidelity becomes utterly hopeless.

However, on the other hand, the acoustic tube has advantageous features such as the possibility of an extremely powerful sound being created therethrough although it is in a confined state in the acoustic tube, and the attenuation of the sound within the tube is extremely low.

The present invention is based on the above described advantageous features of the acoustic tube. According to the invention, various measures are provided for preventing the reflection of sound waves at the ends of the acoustic tube and for eliminating the creation of standing waves, so that the above described drawbacks of the acoustic tube can be eliminated. Thus, when a loss in reproduction of sound of an order of several percent is allowed, the acoustic tube with the remaining percentage of sound can still radiate a far more powerful sound with high fidelity than that of the conventional direct radiating type loudspeakers.

Differing from the conventional direct radiating loudspeakers of a inertia-controlled type in which the amplitude of the radiated sound wave must be enlarged in the low-frequency range in inverse proportion to the second power of the sound frequency, the loudspeaker according to the present invention including a tubular member acting as the above-mentioned acoustic tube can radiated a sound wave in the low-frequency range enlarged in inverse-proportion to the first power of the sound frequency.

Thus, the magnetic flux density of the moving-coil type driving device can be elevated as desired thereby permitting a damping action proportional to the vibration speed of the diaphragm to come into effect in an extremely low frequency range. As a result, the driving side end of the tubular member is assumed to be a closed end although it is actually an opened end, whereby the free oscillation or reflection of the sound within the tubular member can be effectively suppressed. This advantageous feature of the present invention cannot be realized in the direct radiating type speakers of moving-coil type and in microphones whose load impedances cannot be reduced to zero.

Referring to FIG. 1, there is indicated a basic example of a moving-coil loudspeaker according to the present invention. The loudspeaker plurality a diaphragm 1 driven by a moving coil 2 which in turn is arranged in a d.c. magnetic field established by a magnetizing device (not shown). The diaphragm 1 is connected through an annular coupling member 4*a* with an end of a tubular member 3 which has a uniform cross-sectional area S along its longitudinal axis, so that a front chamber 4*b* is defined by the diaphragm 1, the annular coupling member 4*a*, and the end portion of the tubular member 3. In the forward part of the tubular member 3, an acoustic resistance member 5 made of a sound-absorbing material and formed into a conical configuration is inserted. A conical horn 6 having an opening angle of 90° is connected to the forward end of the tubular member 3 for providing an acoustical matching between the air column within the tubular member 3 and the outer atmosphere. The horn 6 is provided at the peripheral edge thereof with a baffle 7 lying in the plane of the opening of the conical horn.

An acoustic impedance transformer is formed by the front chamber 4*b*, the transforming ratio thereof being defined by a ratio between the surface area of the diaphragm 1 and the cross-sectional area S of the tubular member 3. The length of the tubular member 3 is selected in a manner such that it is substantially greater than the longest expected wavelength of the output sound produced from the loudspeaker. Furthermore, the cross-sectional area S of the tubular member 3 is selected to be smaller than the entire surface area of the diaphragm 1, for instance, to be approximately one-tenth thereof.

When the opening angle of the conical horn is greater than a predetermined value, the horn is operated in producing a spherical wave rather than a planar wave of the output sound. In the case where the diameter of the opening of the conical horn is selected to be greater than several tens of centimeters, however, the directional characteristic of the loudspeaker according to the present invention does not deteriorate unlike in the case of the conventional direct-radiation type loudspeaker of the same diameter, and an output power equivalent to that obtainable by a conventional direct-radiation type speaker of nearly one meter in the diameter can be easily obtained in an extremely low frequency range. In the case of the conventional loudspeaker having a cone of a diameter nearly equal to 1 m, it has been almost impossible to provide a directional characteristic and a magnitude of the radiated power comparable to those obtained by the present invention.

It should be noted, however, that the above described advantageous features obtainable by the present invention can be achieved only when the diameter of the tubular member is far smaller than that of the opening of the conical horn so that the tubular member is assumed as a point source of the acoustic power. If the diameter of the tubular member is comparatively large and approximately in a range of from one-third to one-half of the horn diameter, the above described advantages cannot be obtained.

Figure 2A:
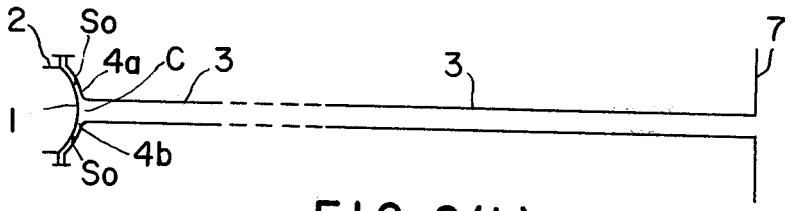
FIG. 2(*a*) is a diagrammatic side view similar to FIG. 1 showing another example of the loudspeaker wherein the cross-sectional area of a front chamber formed between a vibrating plate and a tubular member is made equal to the cross-sectional area of the tubular member.
Figure 2B:
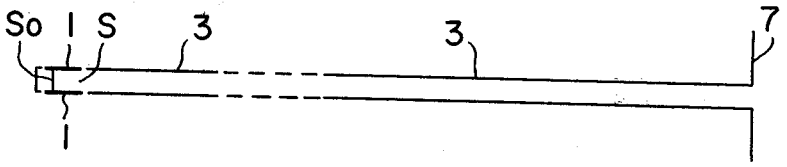

In FIG. 2(*a*), there is indicated an example of the moving-coil loudspeaker according to the present invention wherein the front chamber 4*b* is so formed that the entire annular cross-sectional area so of the front chamber 4*b*, when it is sectional by a sphere of an arbitrarily selected diameter with the center C thereof located on the longitudinal axis of the tubular member 3, is equal to the cross-sectional area S of the tubular member 3.

The loudspeaker of FIG. 2(*a*) can be simulated by an equivalent diagram as shown in FIG. 2(*b*). As will be apparent from the equivalent diagram, the transforming ratio of the acoustic transformer in this example is now independent of the annular sectional area of the front chamber. In the equivalent diagram of FIG. 2(*b*), the diaphragm is represented by a breathing cylinder 1. If the amplitude of the vibration is assumed to be small, the cylinder 1 having the same cross-sectional area as that of the tubular member can be considered to represent the diaphragm 1 shown in FIG. 2(*a*) and can be connected to the tubular member 3, whereby any harmful effect caused by the space forming the front chamber can be eliminated. It should be noted that the same concept is also applicable to horn speakers as well as microphones of a specific type.

Figure 3:
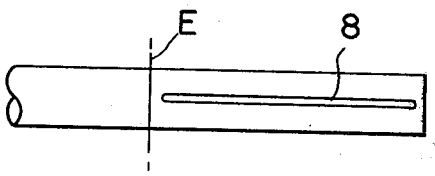
FIGS. 3 and 4 are side views showing respectively end portions of the tubular members wherein acoustic impedance matching slits are provided.
Figure 4:
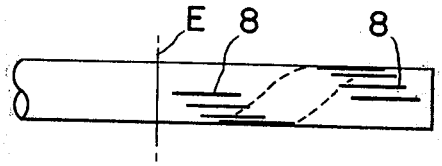

Referring now to FIGS. 3 and 4, there are indicated examples wherein the end partions E of the tubular members are provided with acoustic impedance matching slits 8 so that the effect of the length of the tubular member is thereby made negligible, and any possibility of occurrence of free oscillation within the tubular member is thereby prevented.

Figure 5:
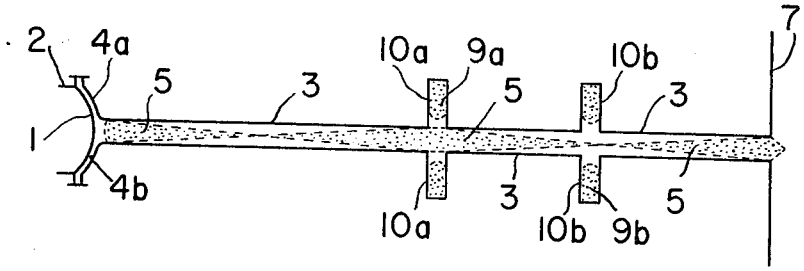
FIG. 5 is a diagrammatic side view, in longitudinal section, showing still another example of the loudspeaker wherein a number of filters are provided along the tubular member.

In the example shown in FIG. 5, chambers 10*a* and 10*b* damped by sound-absorbing bodies 9*a* and 9*b* are provided at positions constituting nodes of the free oscillation of the air column caused within the tubular member. Because of the existence of the chambers 10*a* and 10*b*, the free oscillation of the air column is suppressed, and furthermore the chambers 10*a* and 10*b* can act as filters for cutting out a high frequency portion of the sound transmitted through the tubular member. It is possible, of course, to provide a suitable space in the front chamber thereby to impart a similar filtering action thereto. In the example of FIG. 5, acoustic resistance imparting means 5 consisting of conical sound-absorbing bodies are provided along substantially the entire length of the tubular member 3.

Figure 6:
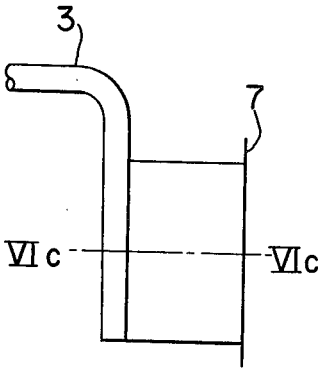
FIGS. 6(*a*), 6(*b*), and 6(*c*) are a side view, front view, and a section taken along the line $VI_c - VI_c$ in FIG. 6(*a*), respectively, of an acoustic impedance matching device provided at the rear end of the tubular member.
Figure 6:
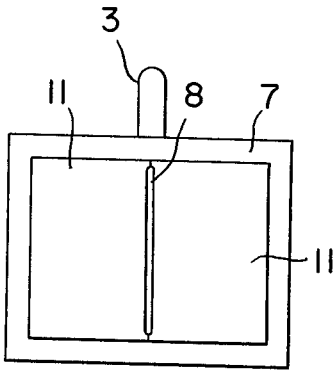
Figure 6:
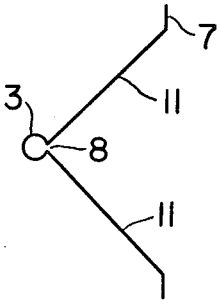

In the example shown in FIGS. 6(*a*), 6(*b*), and 6(*c*), there is provided a slit 8 along the outer end of the tubular member 3 shown in FIG. 3 for imparting acoustical matching between the interior of the tubular member 3 and the outer atmosphere, and two baffles 11 of planar configurations forming therebetween an angle of 90° are provided on the two sides of the slit 8 at the end of the tubular member 3. This example of the loudspeaker radiates a spherical sound wave.

Figure 7:
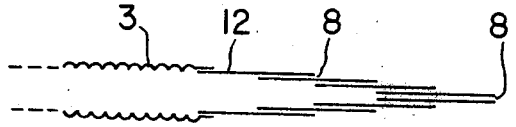
FIGS. 7, 8, 9(*a*), and 9(*b*) are side views showing different examples of acoustic impedance matching devices for the rear end of the tubular member.
Figure 8:
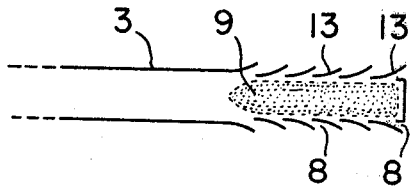
Figure 9A:
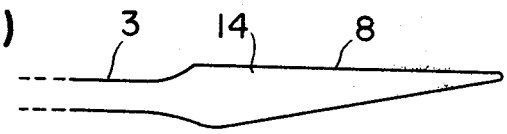
Figure 9B:
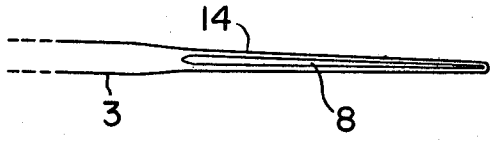

FIGS. 7, 8, 9(*a*), 9(*b*), and 10 illustrate various examples of acoustic matching devices or acoustic resistance imparting devices. Among these, the tubular member shown in FIG. 7 is formed with constrictions in diameter successively distributed along the outer surface.

At the outer end of the tubular member shown in FIG. 7, there is provided a terminal device 12 comprising a plurality of sheaths with successively reduced diameters, and gaps 8 being formed therebetween to function as the slits 8 in the previous examples.

In still another example of the loudspeaker shown in FIG. 8, a terminal device 13 comprising a plurality of sheaths having an outwardly flared ends and connected with each other is provided at the outer end of the tubular member 3. Within the terminal device 13, a sound absorbing body 9 is provided. The plurality of gaps 8 formed between the above described sheaths can function in a similar manner as the gaps 8 in the previous example shown in FIG. 7.

Still another example of the loudspeaker according to the present invention is provided with a terminal device 14 connected to the outer end of the tubular member 3, a plan view and a side view thereof being shown in FIGS. 9(*a*) and 9(*b*), respectively. As is apparent from the figures, the terminal device 14 comprises a flattened member the width thereof as viewed in the plan view being gradually tapered toward the outer end thereof and having a slit 8 opening on each side thereof. The slit 8 functions to radiate sound wave as in the cases of the previous examples.

Figure 10:
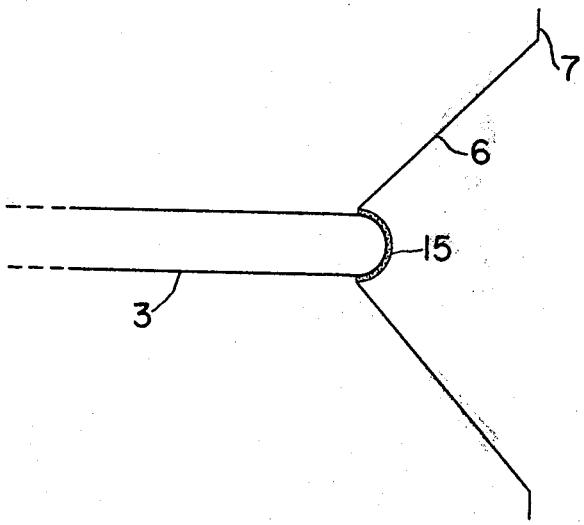
FIG. 10 is a diagrammatic side view showing an example of an acoustic resistance rendering device provided at the rear end of the tubular member.

In still another example as shown in FIG. 10, there is provided a horn 6 having a baffle-board 7 coupled to the outer end of the tubular member 3 via a sound-absorbing body 15 which may comprise a sound-absorbing substance interposed between two semi-spherically formed nets, or a sound-absorbing conical body made of a semi-spherically formed porous substance such as porcelain or a sintered metal, whereby an acoustic resistance is added to the end of the tubular member.

Figure 11:
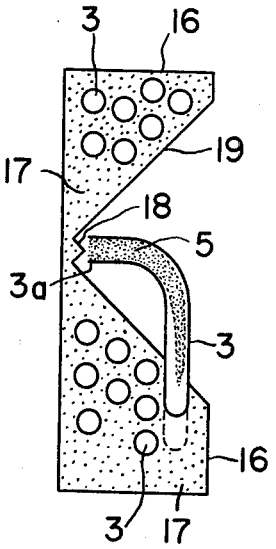
FIG. 11 is a side view, in section, showing an example of a speaker box wherein a tubular member of a wound form is provided.

Still another example of the loudspeaker according to the present invention which can be used in practice more conveniently is indicated in FIG. 11. In this example, the tubular member 3 is wound around the rear part, in a speaker box 16, of a conical horn 19, and the outer end 3*a* thereof is passed through a part of the horn wall to be placed in opposition to a small conical reflecting part 18 provided at the center of the conical horn 19 at a position spaced apart from the outer end 3*a* of the tubular member 3. In FIG. 11 showing the loudspeaker in section, the tubular member 3 wound around the rear part of the conical horn 19 in a relatively compact manner is indicated in the form of a plurality of circles 3, 3, —, and a suitable gap is maintained between the outer end 3*a* of the tubular member 3 and the conical reflecting portion 18 at the center of the conical horn 19 because the most advantageous matching condition should exist between a state completely closing the end 3*a* of the tubular member and a state completely opening the same end 3*a*.

Furthermore, the tubular member is preferably made in a rigid state, and for this reason, the member 3 is preferably made of a material easily wound as described above, and the space in the speaker box 16 outward of the tubular member 3 is after completion filled with a material 17 such as a light-weight foamed concrete, asphalt, wax, resin, and the like in such a manner that the tubular member 3 is embedded and fixed in the filler material 17. In this case, the tubular member 3 can be easily manufactured from a thermoplastic resin, and hence the loudspeaker of this example can be produced by the use of mass-production processes.

Figure 12:
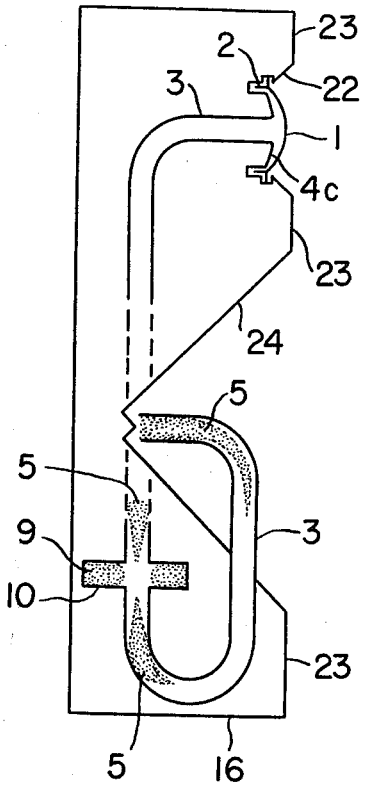
FIG. 12 is a side view, in section, showing still another example of the loudspeaker.

In FIG. 12, there is shown a further example of the loudspeaker according to the present invention, wherein the front surface of a diaphragm 1 driven by moving-coil type driving unit is used as a direct radiating loudspeaker, while the rear side surface of the diaphragm 1 is coupled through a coupling device 2 to a tubular member 3 thereby forming another loudspeaker of a construction as described above. When the space 4*c* formed between the rear surface of the diaphragm 1 and the rear end of the tubular member is formed as described with reference to FIG. 2 with an annular cross-sectional area sectioned by a spherical surface having its center on the longitudinal axis of the tubular member made equal to the cross-sectional area of the tubular member, control of the diaphragm 1 by acoustic resistance in a high-frequency range of the output sound can be assured.

Thus, the sound radiating impedance of the diaphragm 1 becomes a constant value for frequencies higher than a cutoff frequency, the wavelength of which is equal to the circumferential length of the diaphragm 1, whereby output sound of a desired fidelity can be radiated in the high-frequency range.

On the other hand, for the frequencies lower than cutoff frequency of the diaphragm 1, the acoustic impedance is reduced in inverse proportion to the second power of the frequency, and the output sound from the forward surface of the diaphragm 1 is reduced, under resistance control of the impedance, in proportion to the second power of the frequency of the sound.

Thus, at the cutoff frequency, the wavelength thereof being equal to the circumferential length of the diaphragm 1, the sound output from the forward side of the diaphragm is reduced to one half of the above described output, and hence the sound of frequencies lower than the cutoff frequency is radiated mostly from the outer end of the tubular member 3 connected with the rear side chamber 4*c* of the diaphragm 1. It should be noted that an acoustic low-pass filter 10 having a cutoff frequency equal to the above-mentioned cutoff frequency is provided intermediately in the tubular member 3 for preventing a part of sound having frequencies higher than the cutoff frequency from being radiated through the tubular member 3.

In addition, the length of the tubular member 3 may be selected at a value equal to one-half of the wavelength, corresponding to the cutoff frequency, multiplied by an odd number, whereby the phases of the output sounds can be made to coincide at the cutoff frequency. Other parts of this example are similar to those described in the example shown in FIG. 11.

In the direct radiating speaker radiating sound from the forward surface of the diaphragm 1, free oscillation of the diaphragm 1 can be suppressed solely by the acoustic resistance in the tubular member 3 connected to the rear side of the diaphragm 1, and for this reason, the tone color deteriorating noises caused by the vibration losses in the paper of the horn and its edge portion can be substantially eliminated. The acoustic resistance for controlling the free oscillation may further be provided by placing a porous sound-absorbing body 15 as shown in FIG. 10 at a position forwardly spaced apart by a specific distance from the front surface of the diaphragm 1 so that an air chamber is formed therebetween.

In the example of the loudspeaker shown in FIG. 12, a part of sound having frequencies higher than the cutoff frequency is radiated from the forward side 23 of the speaker 16 with the aid of a horn 22, and another part of sound having frequencies lower than the cutoff frequency is also radiated from the forward side 23 of the loudspeaker 16 through the tubular member 3 and a horn 24 similar to the horn 19 in FIG. 11, whereby a listener positioned on the front side of the loudspeaker 16 can hear the sound reproduced with high fidelity throughout the entire frequency range of sound.

I claim:

1. In a loudspeaker of a type including means for producing a steady magnetic field, a moving-coil disposed in said steady magnetic field thereby to effect displacement in accordance with a signal current flowing through said moving-coil and a diaphragm secured to said moving coil for converting the displacement of the moving coil into a sound wave, the improvement comprising a tubular member having a length greater than the wavelength corresponding to any of the frequencies in a frequency range and a constant cross-sectional area smaller than the surface area of the diaphragm throughout the length of the tubular member, a coupling member for coupling one end of said tubular member to one side of said diaphragm in such a manner that an air chamber is formed between said diaphragm and said end of the tubular member, a conical horn at the center of which a small conical reflecting portion is formed, the other end of said tubular member being arranged to face against said small conical reflecting portion with a suitable gap, thereby matching the acoustic impedance of said tubular member to the characteristic acoustic impedance of the outer atmosphere, and at least one acoustic filter provided at a specific position in said tubular member.

2. A loudspeaker comprising in combination:

a. a housing with a rear and forward side (23), of partly rectangular cross-section with defined top, bottom and middle sections in said front side (23);

b. a first horn (22) for higher frequencies in said top section and a second horn (24) for lower frequencies, substantially lager in size than said first horn (22) in said middle section, said second horn including a horn center and a conical wall lower portion;

c. a diaphragm (1) of predetermined circumference driven by a moving coil (2) disposed in a steady magnetic field in said first horn (22) so as to undergo displacement corresponding to a signal current flowing through the moving coil, said diaphragm being secured to the moving coil for converting the displacement of the moving coil into a sound wave;

d. a long tubular member (3) substantially longer than the length of said predetermined circumference, of constant cross-sectional area, said area being smaller than the surface area of said diaphragm, disposed in said housing with a main tubular portion and bent rear and front ends, the main portion of said tubular member (3) extending substantially parallel to said housing rear, said rear end being coupled to said diaphragm (1) across a defined space (4*c*) formed between the rear surface of the diaphragm (1) and and said tubular member rear end, said defined space (4*c*) having an annular cross-sectional area sectioned by a spherical surface having its center on the longitudinal axis of the tubular member rear end substantially equal to the cross-sectional area of the tubular member;

e. a front section to said tubular member including said tubular member front end, said front section extending from said main tubular portion in a hairpin turn and passing out of said conical wall lower portion parallel to said main tubular portion, said front end being inwardly bent to nearly contact said horn center;

f. a low-pass filter (10) on said main tubular portion for wavelengths equal to or greater than the circumference of said diaphragm (1); and, g. acoustic resistance means (5) having sound absorbing material formed at least in said main tubular portion to prevent the formation of standing waves, whereby, the sound cutoff frequency of the diaphragm corresponds to its circumference, thus, the greater part of the sound frequencies higher than the cutoff frequency is radiated by the first horn while the greater part of the sound frequencies lower than the diaphragm is radiated by the second horn, any of the higher frequencies not going through the diaphragm but traveling towards said second horn being cut off by said low-pass filter.

* * * * *